US009064483B2

(12) United States Patent
Alt

(10) Patent No.: US 9,064,483 B2
(45) Date of Patent: Jun. 23, 2015

(54) SYSTEM AND METHOD FOR IDENTIFYING AND CONVERTING FREQUENCIES ON ELECTRICAL STRINGED INSTRUMENTS

(71) Applicant: Andrew J. Alt, Los Angeles, CA (US)

(72) Inventor: Andrew J. Alt, Los Angeles, CA (US)

( * ) Notice: Subject to any disclaimer, the term of this patent is extended or adjusted under 35 U.S.C. 154(b) by 0 days.

(21) Appl. No.: 14/170,714

(22) Filed: Feb. 3, 2014

(65) Prior Publication Data

US 2014/0216235 A1 Aug. 7, 2014

Related U.S. Application Data

(60) Provisional application No. 61/761,408, filed on Feb. 6, 2013.

(51) Int. Cl.
*G10H 1/18* (2006.01)
*G10H 3/18* (2006.01)

(52) U.S. Cl.
CPC . *G10H 3/186* (2013.01); *G10H 3/18* (2013.01)

(58) Field of Classification Search
USPC ..... 84/615, 619, 653, 657
IPC ..... G10H 3/18,3/186
See application file for complete search history.

(56) References Cited

U.S. PATENT DOCUMENTS

| | | | | | |
|---|---|---|---|---|---|
| 2,897,709 | A | * | 8/1959 | McCarty et al. | 84/726 |
| 2,964,985 | A | * | 12/1960 | Webster | 84/723 |
| 2,976,755 | A | * | 3/1961 | Fender | 84/727 |
| 3,177,283 | A | * | 4/1965 | Fender | 84/726 |
| 3,249,677 | A | | 5/1966 | Burns et al. | |
| 3,290,980 | A | | 12/1966 | Fender | |
| 4,065,993 | A | * | 1/1978 | Hirose | 84/715 |
| 4,186,636 | A | * | 2/1980 | Roberts | 84/678 |
| 4,228,712 | A | * | 10/1980 | Uchiyama et al. | 84/655 |
| 4,295,402 | A | * | 10/1981 | Deutsch et al. | 84/715 |
| 4,328,732 | A | * | 5/1982 | Takeda et al. | 84/618 |
| 4,336,735 | A | * | 6/1982 | Amano et al. | 84/617 |
| 4,376,404 | A | * | 3/1983 | Haddad | 84/464 R |
| 4,377,101 | A | * | 3/1983 | Santucci | 84/743 |
| 4,470,332 | A | * | 9/1984 | Aoki | 84/666 |
| 4,472,994 | A | | 9/1984 | Armstrong | |
| 4,481,854 | A | | 11/1984 | Dugas | |
| 4,483,233 | A | * | 11/1984 | Benson | 84/263 |
| 4,495,847 | A | * | 1/1985 | Deutsch et al. | 84/656 |
| 5,189,241 | A | | 2/1993 | Nakamura | |

(Continued)

OTHER PUBLICATIONS

"PARADIS", Original Description of AVALON, http://www.matthiasgrob.org/pParad/ParaPoly.htm, Oct. 20, 2014, pp. 1-3.

*Primary Examiner* — David Warren
(74) *Attorney, Agent, or Firm* — Eckert Seamans Cherin & Mellot, LLC; Philip E. Levy

(57) ABSTRACT

A method of producing an output from an electrical stringed musical instrument, such as a guitar, having a plurality of strings includes steps of (i) receiving a plurality of analog signals, each analog signal being generated in response to vibration of a corresponding one of the plurality of strings and each analog signal having an associated frequency, (ii) identifying from among the analog signals a particular one of the analog signals having the lowest associated frequency, and (iii) creating an output electrical signal based on only the particular one of the analog signals, the output electrical signal having a converted frequency that is lower than the associated frequency of the particular one of the analog signals.

13 Claims, 12 Drawing Sheets

(56) References Cited

U.S. PATENT DOCUMENTS

| | | | | | |
|---|---|---|---|---|---|
| 5,218,160 | A | | 6/1993 | Grob-Da Veiga | |
| 5,455,379 | A | * | 10/1995 | Kim et al. | 84/637 |
| 5,459,281 | A | * | 10/1995 | Shibukawa | 84/637 |
| 5,486,647 | A | * | 1/1996 | Kay et al. | 84/635 |
| 5,723,805 | A | | 3/1998 | Lacombe | |
| 5,796,025 | A | | 8/1998 | Haake | |
| 5,880,391 | A | * | 3/1999 | Westlund | 84/645 |
| 5,932,827 | A | | 8/1999 | Osborne et al. | |
| 5,977,472 | A | * | 11/1999 | Ito et al. | 84/637 |
| 6,281,422 | B1 | * | 8/2001 | Kawamura | 84/615 |
| 6,346,661 | B1 | | 2/2002 | Yaskoweak | |
| 6,747,202 | B2 | | 6/2004 | Kuroki | |
| 6,855,879 | B2 | | 2/2005 | Minakuchi et al. | |
| 6,995,311 | B2 | * | 2/2006 | Stevenson | 84/737 |
| 7,514,626 | B1 | | 4/2009 | Snyder | |
| 7,582,824 | B2 | * | 9/2009 | Sumita | 84/612 |
| 7,799,986 | B2 | * | 9/2010 | Ryle et al. | 84/737 |
| 7,812,243 | B2 | * | 10/2010 | Celi et al. | 84/723 |
| 8,143,509 | B1 | * | 3/2012 | Robertson et al. | 84/604 |
| 8,269,095 | B1 | | 9/2012 | Wallace | |
| 8,502,061 | B1 | * | 8/2013 | Alt | 84/726 |
| 2003/0106411 | A1 | | 6/2003 | Minakuchi et al. | |
| 2004/0187673 | A1 | * | 9/2004 | Stevenson | 84/737 |
| 2007/0227344 | A1 | * | 10/2007 | Ryle et al. | 84/723 |
| 2008/0105101 | A1 | | 5/2008 | Eldring | |
| 2008/0115656 | A1 | * | 5/2008 | Sumita | 84/612 |
| 2009/0223353 | A1 | | 9/2009 | Loftus | |
| 2010/0224051 | A1 | * | 9/2010 | Kurebayashi | 84/637 |
| 2010/0263521 | A1 | | 10/2010 | Ierymenko et al. | |
| 2010/0275761 | A1 | | 11/2010 | Ierymenko | |
| 2012/0125181 | A1 | | 5/2012 | Loftus | |
| 2014/0069264 | A1 | * | 3/2014 | Bialkowski et al. | 84/726 |
| 2014/0216235 | A1 | * | 8/2014 | Alt | 84/726 |

* cited by examiner

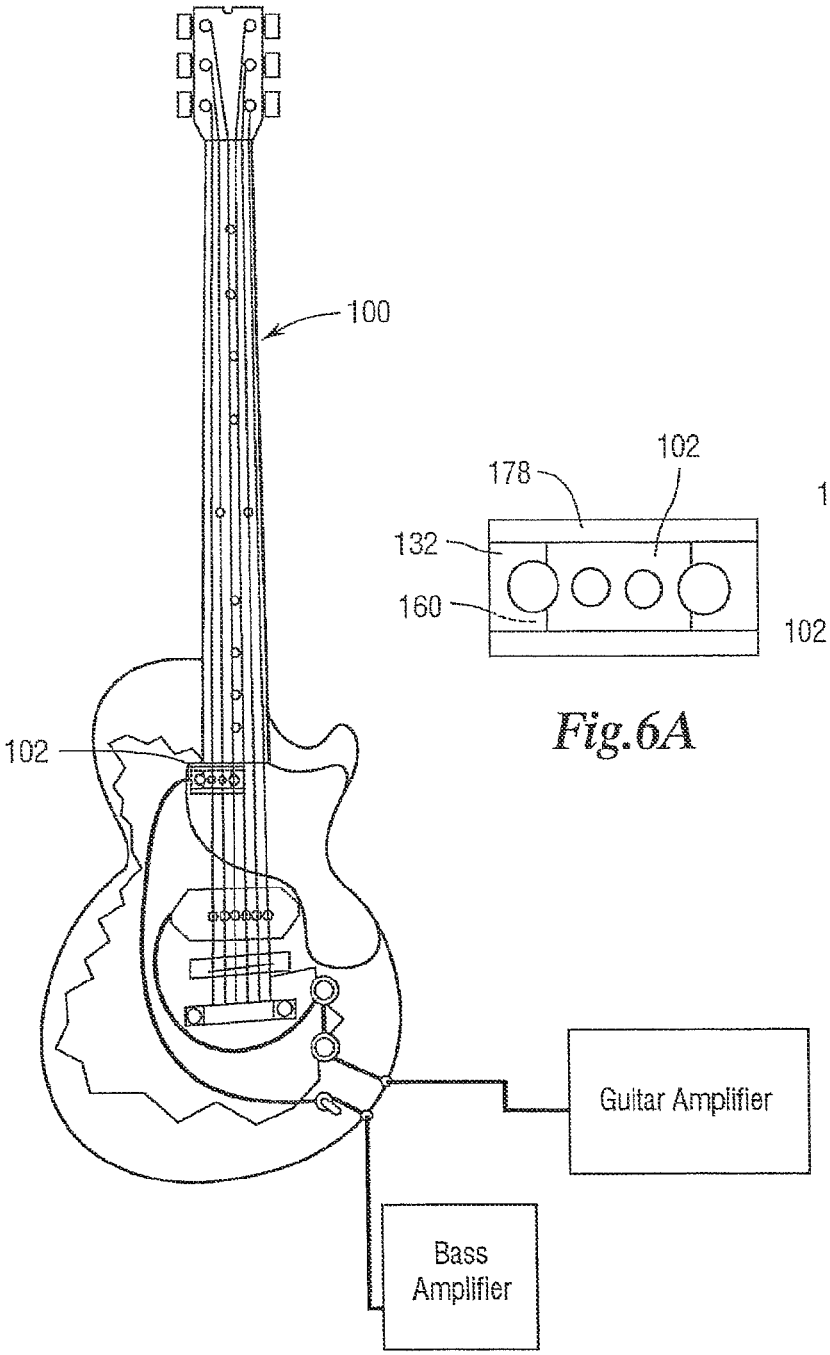
Fig.6A
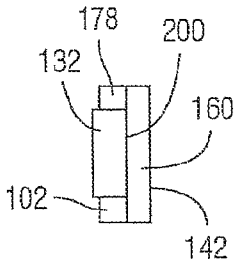
Fig.6B
Fig.6

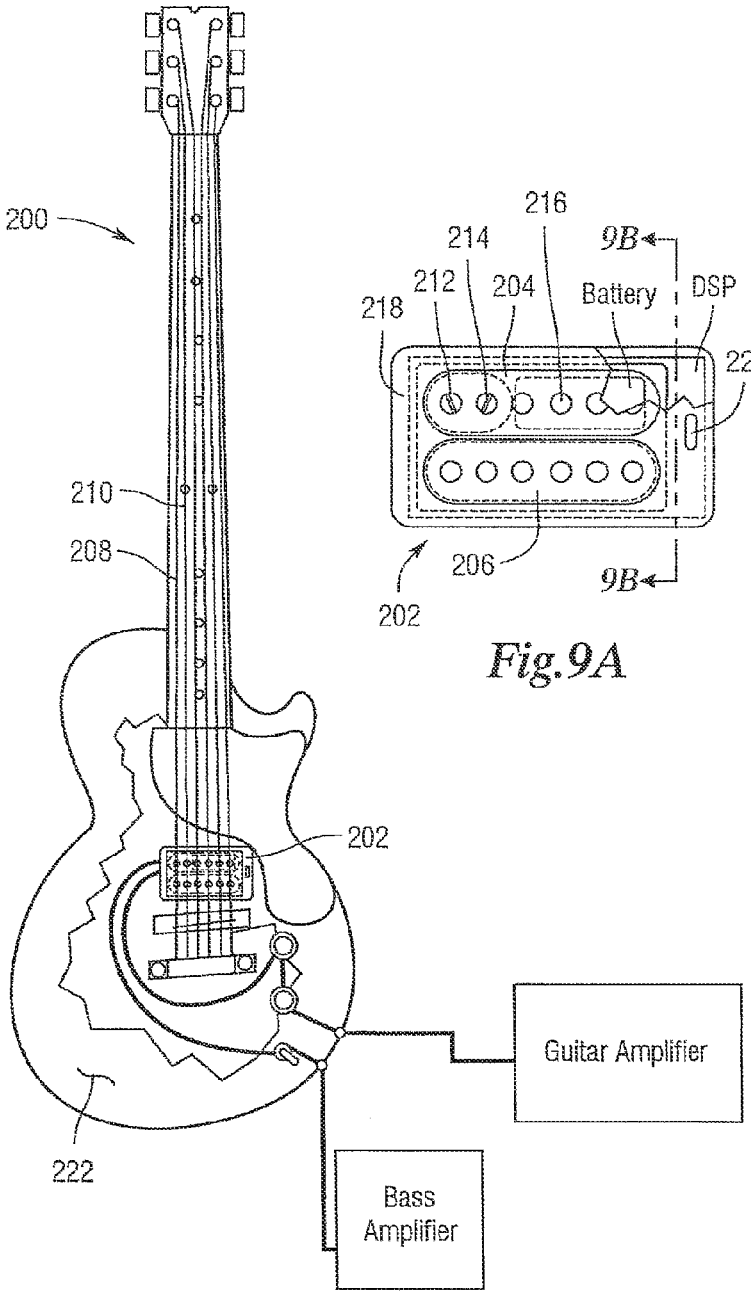
Fig.9A
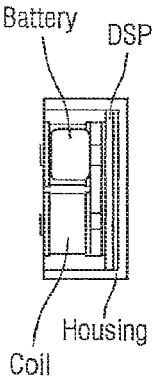
Fig.9B
Fig.10

SYSTEM AND METHOD FOR IDENTIFYING AND CONVERTING FREQUENCIES ON ELECTRICAL STRINGED INSTRUMENTS

CROSS-REFERENCE TO RELATED APPLICATIONS

This application claims priority under 35 U.S.C. §119(e) from provisional U.S. patent application No. 61/761,408 filed Feb. 6, 2013, the contents of which are incorporated herein by reference.

BACKGROUND OF THE INVENTION

1. Field of the Invention

The present invention relates to electrical stringed instruments and signal processing circuits therefor, and, more particularly, to a system and method for producing an output from an electrical stringed musical instrument that detects and converts certain frequencies on the electrical stringed musical instrument.

2. Description of the Related Art

Conventional stringed instruments have a limited audio range. For example, the conventional six string guitar has a limited tonal spectrum and is able to achieve sounds above the lowest open string (when tuned at standard "A 440 Hz" the lowest open string, "E"), which vibrates at 82.41 Hz when plucked.

In the case of conventional guitars, while there is typically some overlap in the audio ranges of a lead guitar and a bass guitar, the lead guitar cannot produce the range that the bass guitar can produce. Consequently, it is common for many types of bands or musical groups to include a musician who plays lead guitar, and a second musician who plays bass guitar.

An alternative would be to provide a guitar with the six strings used for a lead guitar, and additional low end strings that would extend the range of the guitar into the range of a bass guitar. This would allow one musician to play bass and lead on the same guitar. However, it would be difficult, if not impossible, for such a guitar to produce the sound that can be produced by conventional lead and bass guitars played by different musicians. This type of guitar would also be extremely difficult to play, due to the presence of more than six independent strings.

Another alternative, represented by U.S. Pat. No. 4,481,854, is to suppress certain frequencies produced by the strings of a lead guitar in an attempt to selectively lower the range of the strings. This does not, however, produce true bass, in that the range of the sound produced by the strings is not actually shifted into a new range.

U.S. Pat. No. 8,502,061 ("the '061 patent"), entitled "Electrical Stringed Instrument and Signal Processing Circuit Therefor" and invented and owned by the inventor of the present application (the disclosure of which is incorporated herein by reference), describes a methodology for extending the range of an electrical stringed musical instrument (e.g., a conventional lead guitar). More specifically, the methodology of the '061 patent employs first and second pickup circuits, wherein the first pickup circuit is associated with a first set of the strings of the instrument (e.g., all of the strings) and the second pickup circuit is associated with only a subset of the strings of the instrument (e.g., the low E and A strings). According to the methodology, the first pickup circuit is structured to produce a first electrical signal corresponding to a first audio range in response to vibration of one or more of the strings in the subset, and similarly the second pickup circuit is structured to produce a second electrical signal corresponding to the first audio range in response to vibration of the one or more of the strings in the subset. However, also according to the methodology, the second electrical signal is converted into a third electrical signal corresponding to a second audio range different than the first audio range (e.g., one octave lower) using a signal processor of the second pickup circuit. As a result, a user of the instrument is able to produce sounds in both the first audio range and the second audio range using the subset of strings, and may do so simultaneously. Thus, in the case where the instrument is a conventional (lead) guitar, the user may generate conventional lead guitar sounds and bass guitar sounds by strumming the subset of strings, and may do so simultaneously.

Furthermore, in the methodology described in the '061 patent, if multiple strings from the subset of strings (e.g., all of the strings in the subset) are played at the same time, the signal from each of those strings will be converted to the lower audio range and multiple bass notes will be resounded. This will often result in an undesirable muddy or muddled sound. This application addresses this issue with a variety of solutions.

SUMMARY OF THE INVENTION

In one embodiment, a method of producing an output from an electrical stringed musical instrument, such as a guitar, having a plurality of strings is provided. The method of this embodiment includes steps of (i) receiving a plurality of analog signals, each analog signal being generated in response to vibration of a corresponding one of the plurality of strings and each analog signal having an associated frequency, (ii) identifying from among the analog signals a particular one of the analog signals having the lowest associated frequency, and (iii) creating an output electrical signal based on only the particular one of the analog signals, the output electrical signal having a converted frequency that is lower than the associated frequency of the particular one of the analog signals.

In another embodiment, an electrical stringed musical instrument is provided that includes a plurality of strings and a pickup circuit structured to (i) generate a plurality of analog signals, each analog signal being generated in response to vibration of a corresponding one of the plurality of strings and each analog signal having an associated frequency, (ii) identify from among the analog signals a particular one of the analog signals having the lowest associated frequency, and (iii) create an output electrical signal based on only the particular one of the analog signals, the output electrical signal having a converted frequency that is lower than the associated frequency of the particular one of the analog signals.

In still another embodiment, a pickup unit for an electrical stringed instrument having a plurality of strings is provided that includes an electromagnetic pickup structured to generate a plurality of analog signals, each analog signal being generated in response to vibration of a corresponding one of the plurality of strings and each analog signal having an associated frequency, and a signal processor structured to (i) identify from among the analog signals a particular one of the analog signals having the lowest associated frequency, and (ii) create an output electrical signal based on only the particular one of the analog signals, the output electrical signal having a converted frequency that is lower than the associated frequency of the particular one of the analog signals.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

FIG. 6 shows another guitar that employs a signal processing circuit for extending the range of the guitar, in which part of the bass signal processing circuit is mounted beneath the bass pickup, and the battery surrounds the bass pickup;

FIG. 6A is a plan view of the pickup unit shown in FIG. 6;

FIG. 6B is a side view of the pickup unit shown in FIGS. 6 and 6A;

FIGS. 9A and 9B are front and side views, respectively, of a standard "humbucker" pickup that has been modified to serve as the unit that houses the lead and bass pickups and the rechargeable battery with the DSP Octaver attached;

FIG. 10 is a view of a guitar in which the unit shown in FIGS. 9A and 9B has been mounted;

DETAILED DESCRIPTION OF EXEMPLARY EMBODIMENTS

Figure 1:
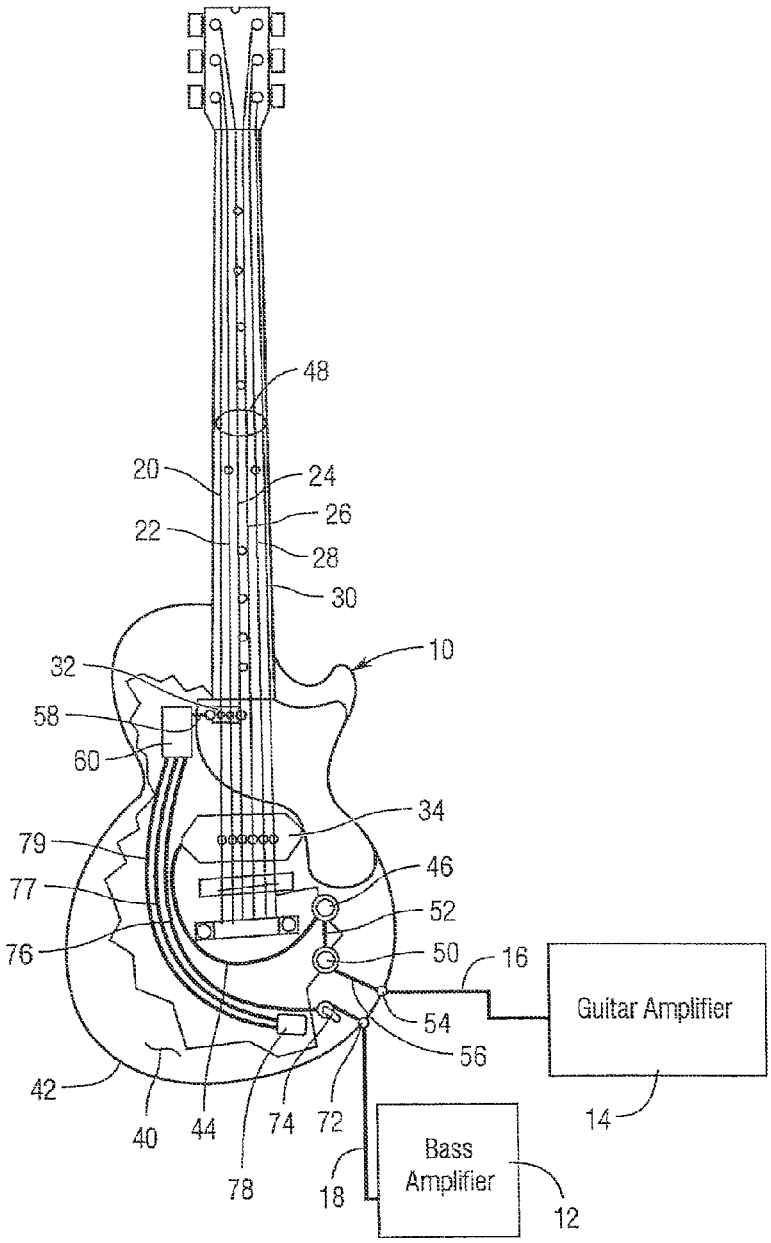
FIG. 1 shows a guitar provided which employs a signal processing circuit for extending the range of the guitar.
Figure 2:
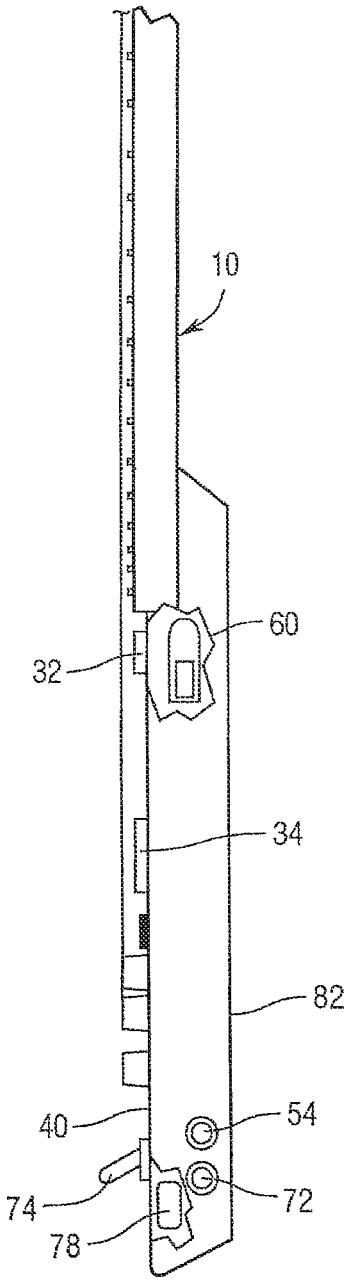
FIG. 2 is a side view of the guitar shown in FIG. 1.
Figure 3:
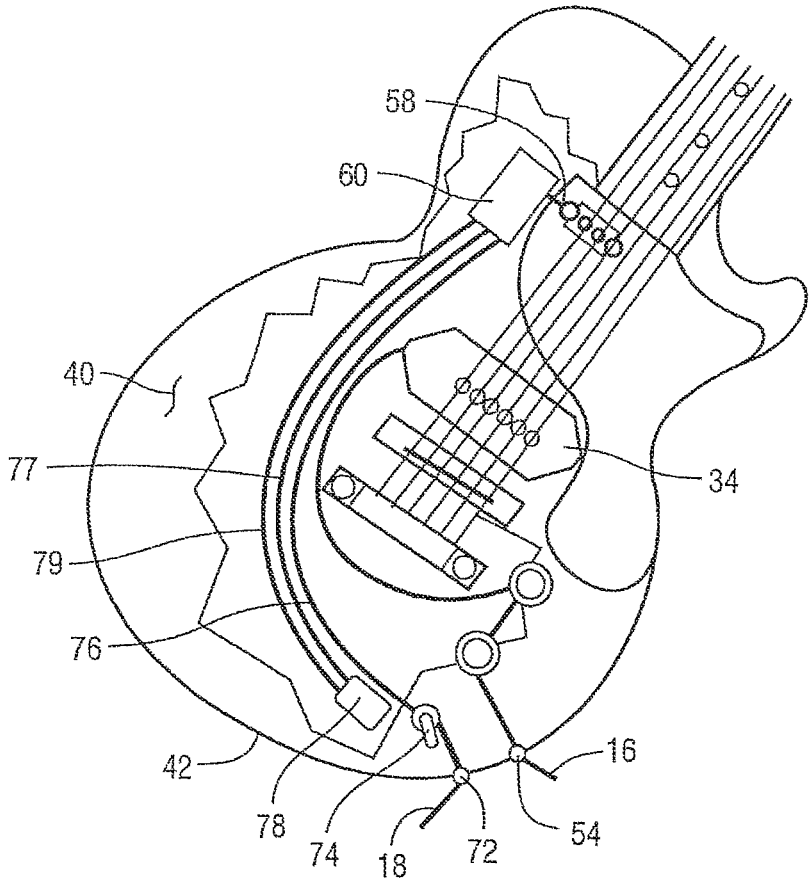
FIG. 3 is a view of a portion of the guitar shown in FIG. 1.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As noted elsewhere herein, the '061 patent provides a signal processing circuit that permits any electric stringed instrument to produce audio in an extended range, and an electric stringed instrument that employs the signal processing circuit. However, as also noted elsewhere herein, the system and methodology described in the '061 patent will, in certain circumstances, produce a less than optimal sound. In order to address this issue, the present invention provides an enhancement of the system and methodology of the '061 patent application that prevents muddled bass chords resulting from simultaneous converted frequencies from resounding through an amplifier by giving the lowest analog note (often the "root") produced by the playing (strumming) of the strings from the subset of strings that is down converted to a lower frequency "priority" and only converting that note/signal to the lower audio range and subsequently outputting it through an amplifier.

For a good understanding of the enhancement of the present invention, it is important to first provide a detailed description of the system and methodology of the '061 patent. Such a detailed description is provided herein in connection with FIGS. 1-11 of the present application, which correspond to FIGS. 1-11 of the '061 patent. In addition, for ease of illustration, the enhanced methodology of the present invention will be described in detail elsewhere herein in connection with and as implemented on the guitar 200 and the pick-up unit 202 shown in FIGS. 9A, 9B and 10 and describe herein. It will be understood, however, that that is meant to be exemplary only and that the enhanced methodology of the present invention may be implemented in connection with other configurations shown in the '061 patent and described herein and/or other similarly configured electrical stringed instruments.

The following is a detailed description of the system and methodology of the '061 patent, wherein exemplary embodiments are described in the context of a lead guitar. While this description describes a guitar constructed according to the teachings of the '061 patent, it also should be noted that the description encompasses a conventional lead guitar that has been retrofitted with the signal processing circuit described herein to achieve a lead guitar with an extended audio range. In the exemplary embodiments, the extended range is the conventional audio range produced by a lead guitar, and at least part of the bass audio range produced by a conventional bass guitar. In the case of both of the exemplary embodiments of the '061 patent described herein, the two lowest strings of the lead guitar are used to produce both the bass component of the extended range, and the lead component. Each of these components can be played alone or simultaneously. The two lowest notes on the lead guitar when tuned to standard tuning of "A 440 Hz" are the low "E" string and the "A" string. When the guitarist chooses to play the lead component, either alone or in combination with the bass component, the amplifier plays the lead sound typically produced by these strings. When plucked, these strings actually vibrate at 82.41 and 110. Hz, respectively. When the bass signal processing circuit is engaged, the frequencies of the electrical signals associated with these two lowest guitar strings are transformed one octave below, producing the exact frequencies found on the low "E" and "A" strings found on a bass guitar. Hence, the bass signal processing circuit, when engaged, converts the frequency of the signal associated with the "E" string to 41.20 HZ, and the signal associated with the "A" string to 55.00 Hz. The bass signal processing circuit permits the audio to be dropped an octave further. In that case, the frequency of the signal associated with the lowest "E" string becomes 20.60 Hz and the signal associated with the "A" string becomes 27.50 Hz. This is an octave below that of a conventional bass when tuned to the standard A=220 Hz pitch. Whether the entire bass range of a conventional bass guitar is produced, or only a part of the range is produced, is a matter of choice. The exemplary embodiments described below use the lowest two strings of the guitar as the source of the bass audio. It is within the scope of the system of the '061 patent to use any or all the strings of a guitar or other stringed instrument as the source of the extended component of the audio. Further, the exemplary embodiments employ the same six strings provided for a conventional lead guitar. Other strings could be used, again, as a matter of choice.

Figure 4:
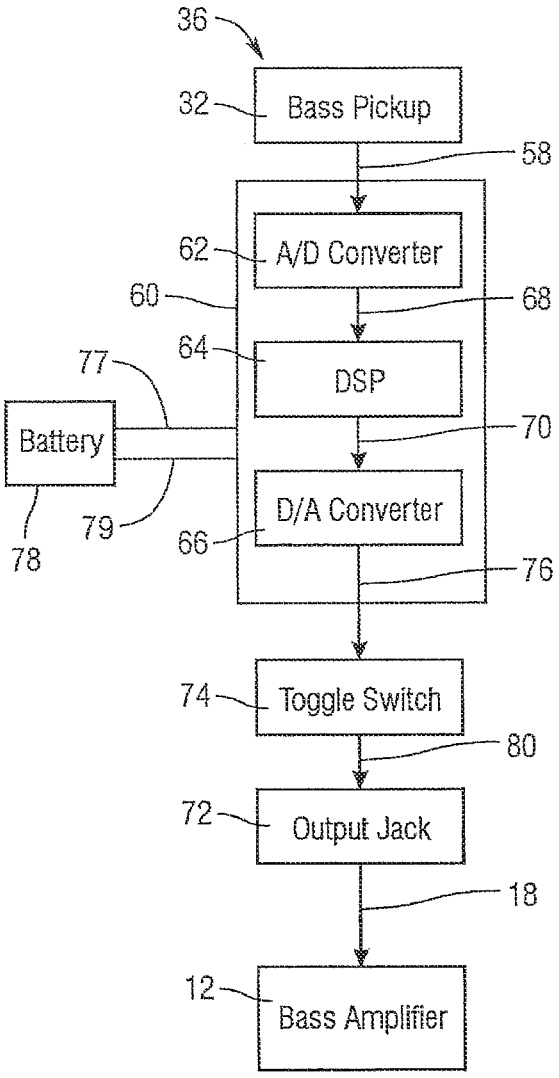
FIG. 4 shows the bass signal processing circuit for extending the range of the guitar shown in FIG. 1.
Figure 5:
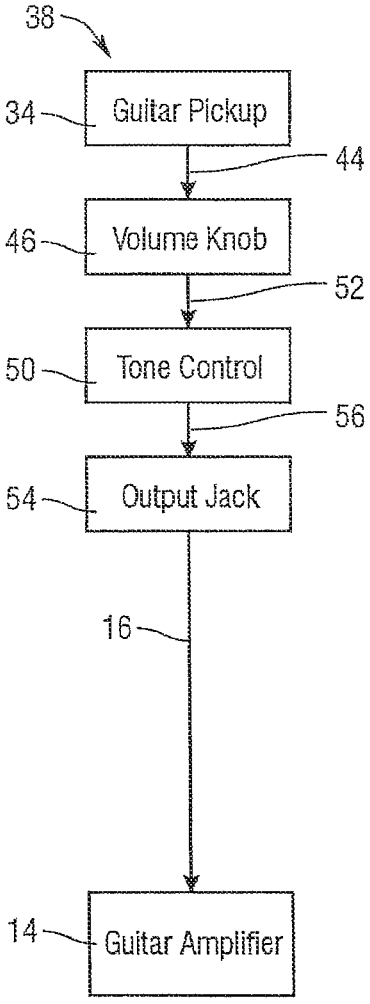
FIG. 5 shows the lead or guitar circuit of the guitar shown in FIG. 1.
Figure 7:
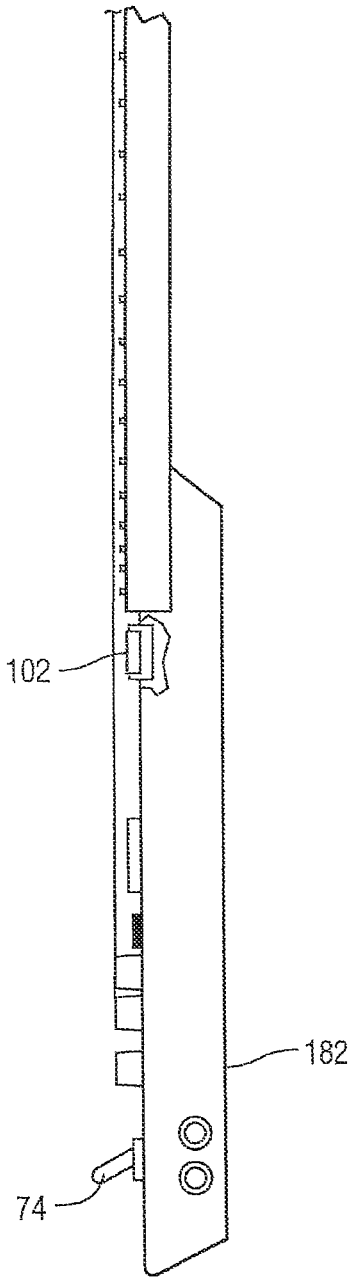
FIG. 7 is a side view of the guitar shown in FIG. 6.
Figure 8:
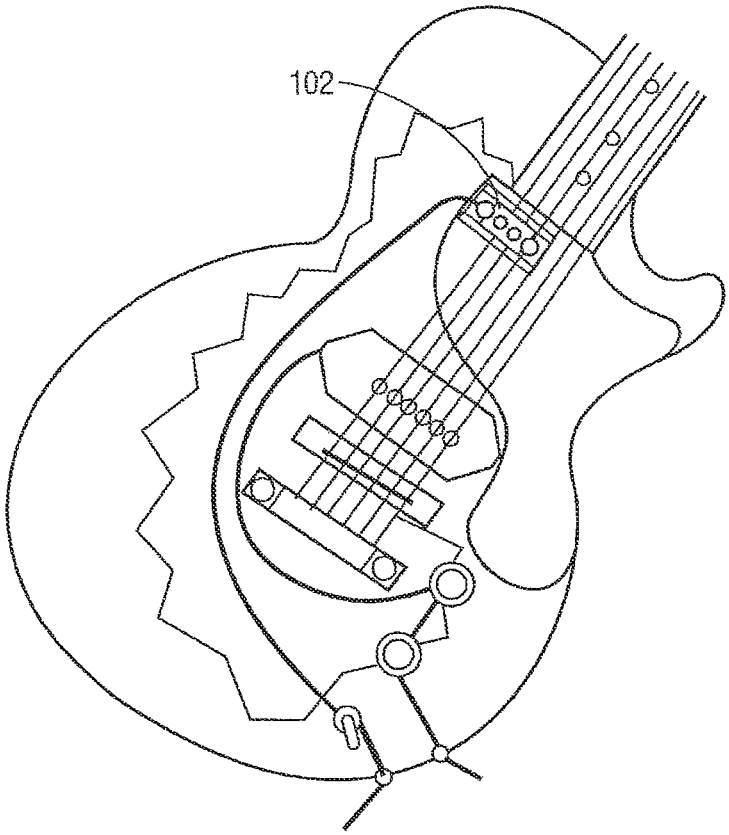
FIG. 8 is a view of a portion of the guitar shown in FIG. 6.
Figure 11:
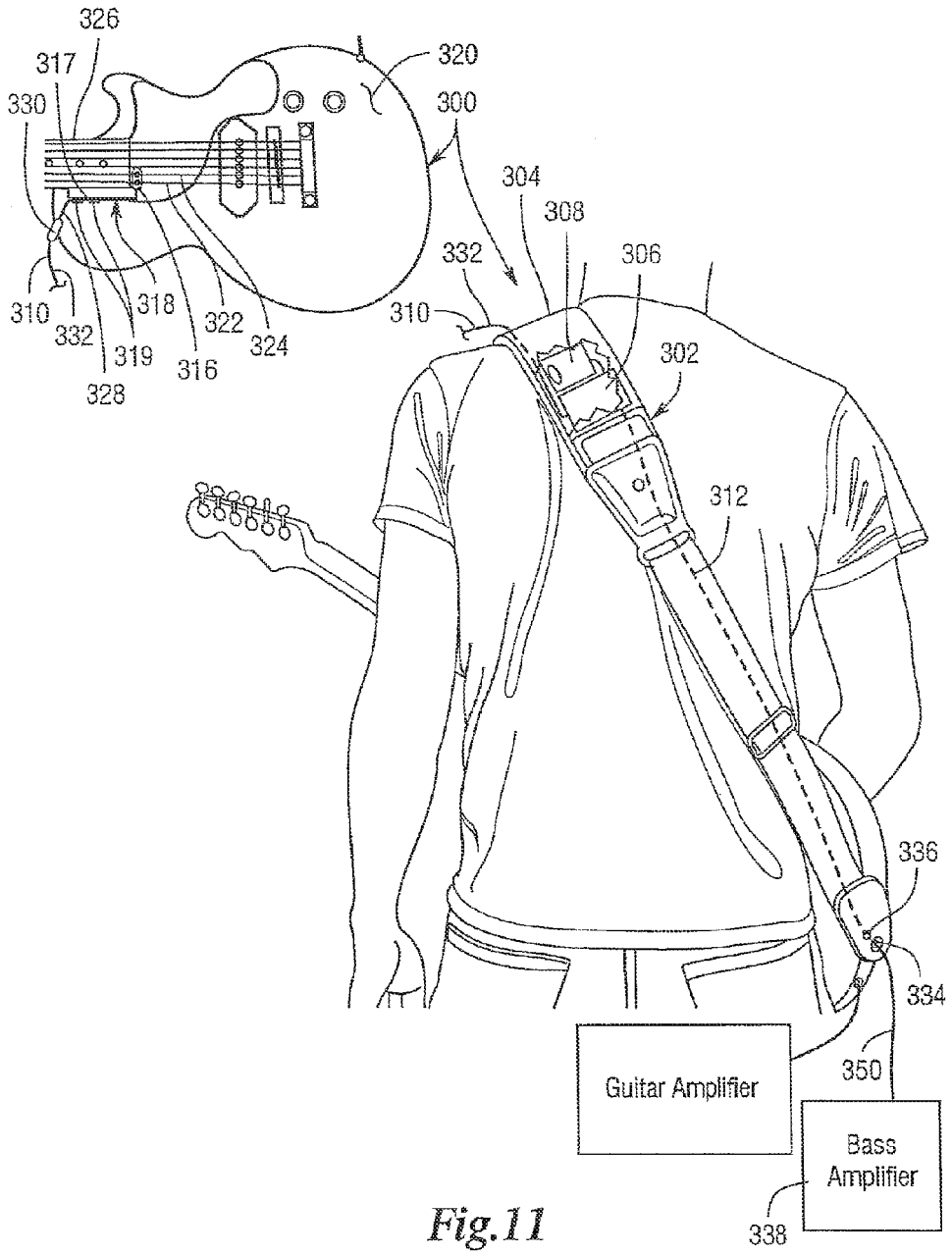
FIG. 11 shows another embodiment in which the signal processing unit is housed in a guitar strap.

FIG. 1 shows a guitar 10 provided according to the teaching of the '061 patent, along with conventional bass amplifier 12 and lead guitar amplifier 14. Guitar 10 produces conventional lead guitar audio through guitar amplifier 14 when strings 48 of guitar 10 are played. Guitar 10 also employs a bass signal processing circuit of the type provided by the '061 patent, the preferred embodiment of which is shown in FIG. 4, to produce sound through bass amplifier 12 in the bass audio range. In this preferred embodiment, the conventional lead audio and bass audio constitute the extended audio range produced by guitar 10. Guitar 10 can produce lead audio only, bass audio only, or bass and lead audio together.

Guitar amplifier 14 receives electrical signals from guitar 10 along line 16 that are associated with the normal audio range provided by the six strings of guitar 10 when they are played. Amplifier 14 produces sound in this range in the conventional manner. A bass amplifier 12 receives electrical signals from guitar 10 along a conventional ¼" instrument cable 18 that are associated with bass audio produced by the bass signal processor circuit from the two lower strings 20 and 22 of guitar 10. In the preferred embodiment, as will be seen below, guitar 10 can produce lead and bass audio simultaneously from strings 20 and 22, or it can produce either lead or bass individually.

Guitar 10 employs a pair of conventional transducers that produce signals corresponding to the vibration of one or more of the strings 48 of guitar 10. Preferably, the transducers are a pair of conventional electromagnetic pickups 32 and 34 that are commonly employed with electric guitars and other stringed instruments. Each of pickups 32 and 34 produces in the well-known and conventional manner analog electrical signals related to the frequencies of vibration of the strings proximate the pickup. A first pickup 34 is associated with all six strings 48 of guitar 10, and produces the electrical signals that are fed to amplifier 14 to produce the conventional sound produced by a lead electric guitar. A second pickup 32 is mounted to guitar 10 below the two lowest strings 20 and 22 of guitar 10, which is used to convert the vibration of strings 20 and 22 to electrical signals that are used to create sound in the bass range.

Referring to FIGS. 1 through 5, guitar 10 includes bass signal processing circuit 36 and lead or guitar signal processing circuit 38. FIG. 1 is partially cut away to reveal a portion of the interior of guitar body 42 to show internal wiring of guitar 10. Lead or guitar processing circuit 38 (FIG. 5) is the conventional circuit employed in a conventional lead guitar to produce amplified sound from the vibration of the six strings of the guitar. Pickup 34 is mounted to the upper surface 40 of guitar body 42 beneath strings 48. Pickup 34 produces electrical signals along line 44 to volume control 46 that are related to the frequencies of vibration of strings 48. Volume control 46 is conventional, and used to control the volume of sound produced through guitar amplifier 14. The signals are input from volume control 46 to tone control 50 along line 52. Tone control 50 and its conventional circuitry (not shown) are used by the musician playing guitar 10 to control the tone of the lead audio produced through guitar amplifier 14. The signal produced by tone control 50 is input to output jack 54 along line 56. Conventional ¼" instrument cable 16 is plugged into output jack 54 and guitar amplifier 14, along which the output signal from guitar 10 is input to guitar amplifier 14. Guitar amplifier 14 produces the conventional lead guitar sound produced by a lead electric guitar when its strings 48 are played.

Bass signal processing circuit 36 (FIG. 4) is the circuit that allows production of part or all the bass range produced by a conventional bass electric guitar. In the case of the preferred embodiment, the bass range is produced from the lowest two strings 20 and 22 of guitar 10. Either lead alone can be produced from strings 20 and 22, or bass and lead can be produced simultaneously from strings 20 and 22. Further, lead processing circuit 38 permits complete suppression of lead from strings 20 and 22 using lead volume control 46 to reduce the lead volume to zero, allowing strings 20 and 22 to produce bass sound only through guitar amplifier 12.

In particular, pickup 32 is mounted to the upper surface 40 of guitar body 42 beneath strings 20 and 22. Pickup 32 provides electrical signals along line 58 to a polyphonic octaver 60 the frequencies of which are related to the vibrations of strings 20 and 22. Polyphonic octaver 60 is a conventional, readily available processor that alters the frequencies of the electrical signals it receives using standard algorithms contained and selected by the user on octaver 60. A suitable octaver for this purpose is available from Boss/Roland Corporation, as Model No. OC-3 "Super Octave". In the case of the preferred embodiment, octaver 60 is used to halve or quarter the frequency of the signals received by octaver 60 from base pickup 32 to produce sound in the desired bass range.

Octaver 60 includes an analog to digital converter, or A/D converter, 62, a digital signal processor, or DSP, 64, which includes the signal modifying algorithms, and a digital to analog converter, or D/A converter, 66. A/D converter 62 receives the signals produced by bass pickup 32 along line 58. The signals on line 58 can be substantially the same as the signals on line 44 in lead signal processor circuit 38 produced by the vibration of strings 20 and 22. A/D converter 62 converts the analog signals on line 58 to digital signals, which are input to DSP 64 along line 68 (see FIG. 5). DSP 64 converts the frequencies of the signals on line 68 to the frequencies needed to produce bass audio in the desired range, using standard algorithms in DSP 64. DSP 64 inputs the converted digital signals to D/A converter 66 along line 70. D/A converter 66 converts the digital signals it receives back to analog signals, which are input to a conventional toggle switch 74 along line 76. Toggle switch 74 is used either to prevent the signals on line 76 to be input to bass amplifier 12 when it is desired not to produce bass audio, or to allow the signals on line 76 to be input to amplifier 12 when the production of bass audio is desired. When the guitarist wishes to produce bass only, volume control 46 can be adjusted to zero to completely eliminate lead audio. When the guitarist wishes to produce lead audio only, toggle switch 74 is moved to the "off" position to prevent production of bass audio. When switch 74 is in the "on" position, and volume control 46 is adjusted to a non-zero position, guitar 10 produces both bass audio and lead audio. A standard 9 volt battery 78 provides power to octaver 60 along lines 77 and 79. Battery 78 is a conventional alkaline or rechargeable 9 volt battery rated at 300-500 mAh and 9 volts.

Toggle switch 74 permits the musician to turn the bass audio on and off. When toggle switch 74 is in the "off" position, bass signal processing circuit 36 is "open", signals cannot flow from D/A converter 66 to output jack 72 in guitar body 42, and strings 20 and 22 do not produce bass audio through amplifier 12. When toggle switch 74 is in the "on" position, bass signals can flow from D/A converter 66 to output jack 72. Conventional cable 18 is plugged into output jack 72 and bass amplifier 12, along which the bass output signals from guitar 10 are input to bass amplifier 12 from jack 72. Bass amplifier 12 produces sound from these signals in the desired bass range when strings 20 and 22 are played.

A guitar 10 including a signal processing circuit 36 can be produced as a new product, or it can result from retrofitting a conventional lead guitar with a bass signal processing circuit 36. In either case, as shown in FIG. 1, octaver 60 can reside in a compartment formed within guitar body 42. A panel (not shown) in rear surface 82 of guitar body 42 provides access to octaver 60, cables 76, 77 and 79, and battery 78. To retrofit an existing guitar, the necessary interior of body 42 can be hollowed to form the compartment for octaver 60, cables 76, 77 and 79 and battery 78, and bass pickup 32, toggle switch 74 and jack 72 can be mounted in any conventional manner to body 42.

FIGS. 6, 6A, 6B, 7 and 8 show an alternate embodiment 100 described in the '061 patent. Embodiment 100 is a guitar that is identical to guitar 10, with several exceptions. Components that are common to both guitar 10 and guitar 100 are designated by the same reference characters.

Guitar 100 is identical to guitar 10 with the exception of the location of the octaver 160 and the location and physical configuration of the lithium ion or lithium polymer battery 178, which are mounted to guitar 100 in a manner that differs from the mounting of the octaver 60 and battery 78 to guitar 10. As can be seen best in FIGS. 6, 6A, 6B and 7, a pickup unit 102 includes a battery 178, octaver 160 and bass pickup 132. Pickup 132 remains a conventional guitar pickup. Battery 178 is physically configured in any known manner to surround bass pickup 132. In this configuration, battery 178 also functions as the conventional collar employed in a convention pickup to aid in holding the pickup in place on a guitar. Similarly, octaver 160 is mounted beneath pickup 132, between the lower surface 200 of pickup 132 and the upper surface 142 of guitar 100. Suitable electrical connections are provided among pickup 132, octaver 160 and battery 178 in accordance with the teachings provided above. This configuration is simpler, and easier to implement. Battery 178 features a micro USB port on it, allowing it to be charged by a conventional AC wall charger operating at 110 volts in the US or 220 volts in the UK.

Another variation 200 includes an all-in-one pickup unit 202. Unit 202 is a modified "humbucker" sized pickup. Unit 202 takes the place of pickups 32 and 34 of guitar 10, and includes two pickups 204 and 206. Pickup 206 acts as the pickup that produces lead audio sound, serving the function of pickup 34 of guitar 10. Pickup 204 acts as the pickup that produces bass audio from strings 208 and 210. In particular, coils 212 and 214 are positioned below strings 208 and 210, and produce electrical signals that are associated with those two strings in the conventional way. Coils 216 are deactivated, and have no function. A micro USB connection 220 is formed in pickup ring 218 of unit 202, and is used as a means of charging a battery (not shown) that is mounted within unit 202 under dummy coils 216. An octaver (not shown) is mounted under unit 202 between the lower surface of unit 202 and the upper surface 222 of guitar 200. In all other respects, guitar 200 functions like guitars 10 and 100. Unit 202 is inserted into a cavity formed in guitar 200, just like a conventional "humbucker" sized pickup. The dummy coils or poles 216 house a battery that powers the DSP unit mounted below or embodied within the guitar 200. The pickup ring 218 around this configuration would feature a micro USB port 220, allowing the battery inside the dummy coils 216 to be recharged when not in use.

Yet another variation, 300, achieves the same result. An all-in-one guitar strap system unit 302 includes a conventional guitar strap 304 that has been modified to house Octaver DSP unit 306, a rechargeable battery 308 featuring a micro USB charge port, and wires 310 and 312. A floating two piece pole pickup unit 318 is also provided to produce the signals from strings 322 and 324 that are used to produce sound in the bass range. Floating pickup 318 is a standard, readily available unit that is typically used when it is not desired or not possible to route, drill and/or mount the pickup directly to or within the top surface of a guitar body. In the case of guitar 300, however, a floating pickup is used to facilitate providing the signal produced by the "bass pickup" to the electrical components provided in strap 304 of guitar 300.

Unit 318 includes a pickup 316 and a mounting 317. Pickup 316 is not mounted directly to the upper surface of guitar body 320. Rather, pickup 316 is secured to clip or mounting 317, which in turn is mounted to the side of neck 326 of guitar 300. Thus, mounting 317 fixes the position of pickup 316 beneath strings 322 and 324 of guitar 300. Pickup 316 itself is a conventional pickup similar in function to the previous versions identified above. However, unit 318 is what is commonly known in the guitar industry as a "floating pickup". Rather than being mounted directly to the body 320 of guitar 300, "floating pickup" unit 318 is mounted to the guitar through a metal clip or mounting 317, which is mounted with screws 317 into the side of the end of neck 326 of guitar 300, as opposed to being mounted into the body 320 of guitar 300. This pickup arrangement allows the entire pickup to "float" above the body 320 of guitar 300 but still be located under strings 322 and 324. Unit 318 functions just like the previously described bass pickups. The benefit of having pickup 316 located entirely above body 320 is that all associated wiring is visible and accessible above body 320 as well. Wiring 328 coming from pickup 316 and mounting 317 is wrapped once around conventional strap lock 330 on the guitar's body 320. Strap 304 is secured in the conventional manner to strap lock 330 of guitar body 320 when in use to mount that end of strap 304 to body 320. Shielded, flexible rubber tubing 332 surrounds wire 310, which is then fed into the top of the guitar strap 304. Wire 310 includes extra slack within the rubber tubing 332, allowing the guitar player to move freely while the instrument is in play. The wire 310 is then connected to the A/D converter of the Octaver 306 and then out of the D/A converter of the Octaver 306. The Octaver 306 is secured in one place within the strap 304 by being sewn into place on both sides of its location. Octaver 306 can be identical to and operate on the signals produced by pickup 316 in the way as the Octavers in guitars 10, 100 and 200. Wire 312 carries the modified signals produced by pickup 316 to bass amplifier 338.

Wire or cable 312 travels within strap 304 to a switch 336, which, as with the other embodiments, is used to provide or suppress audio in the bass range. The wire 312 travels from switch 336 to the bottom of the strap 304 where it is soldered to a conventional ¼" jack 334. From the jack 334, any conventional ¼" cable 350 can be used to connect wiring 312 to bass amplifier 338 to produce a bass tone.

Having described the embodiments of the '061 patent, the focus will now turn to a description of the enhancement to the system and methodology of the '061 patent application that is the subject matter of the present invention. As noted elsewhere herein, in the methodology described in the '061 patent, if multiple strings from the subset of strings of the instrument (e.g., all of the strings in the subset) are played at the same time, the signal from each of those strings will be converted to the lower audio range and multiple bass notes will be resounded. Unfortunately, this will in many cases result in less than optimal sound production (e.g., an undesirable muddy or muddled sound). In order to address this issue, described herein is an enhancement of the system and methodology of the '061 patent that prevents muddled bass chords from resounding through an amplifier by giving the lowest analog note (often the "root") produced by the playing (strumming) of the strings from the subset of strings "priority" and only converting that note/signal to the lower audio range and subsequently outputting it through an amplifier.

As state elsewhere herein, the enhanced methodology of the present invention will, for ease of illustration, be described in detail in connection with and as implemented on the guitar 200 and the pick-up unit 202 shown in FIGS. 9A, 9B and 10. It will be understood, however, that that is meant to be exemplary only and that the enhanced methodology of the present application may be implemented in connection with configurations than as shown in FIGS. 9A, 9B and 10 and/or other similarly configured electrical stringed instruments.

The enhanced methodology of the present invention is described in more detail below in connection with the flow chart of FIG. 12. However, in general, in the enhanced methodology of the present invention, the digital signal processor (DSP 64, FIG. 4) receives an analog signal for each of the strings in the subset of strings associated with pickup unit 204 that is played (strings 208 and 210) (the "notes in play"), determines which of the notes in play is the lowest frequency, and applies an effect to only that specific string wherein the signal/note is converted to a lower audio range (e.g., down one or two octaves). Thus, with this feature, only the lowest note being played from the subset of strings associated with pickup unit 204 (i.e., the strings that have the potential for frequency conversion, which are strings 208 and 210 in the present example) actually receives the octave effect (as produced by the DSP 64 of pick-up unit 202, FIG. 9A), thereby allowing a conventional electrical guitar to produce a tone in the same range of that found on a bass guitar without a muddy or muddled quality. In other words, when multiple bass frequencies are possible as a result of playing/strumming multiple strings from the subset of strings having conversion potential, the DSP 64 chooses only the lowest note actually being played/generated (i.e., the lowest note currently being produced by the two strings 208 and 210 in the present example) to convert to a different audio range and ultimately send through the output jack to the bass amplifier As described elsewhere herein, this bass output may be provided simultaneously with the conventional lead guitar signals that are generated by strumming the stings of the guitar, including simultaneously with a lead guitar sound generated from the one of the subset of strings associated with pickup unit 204 and determined to have the low note priority.

Figure 12:
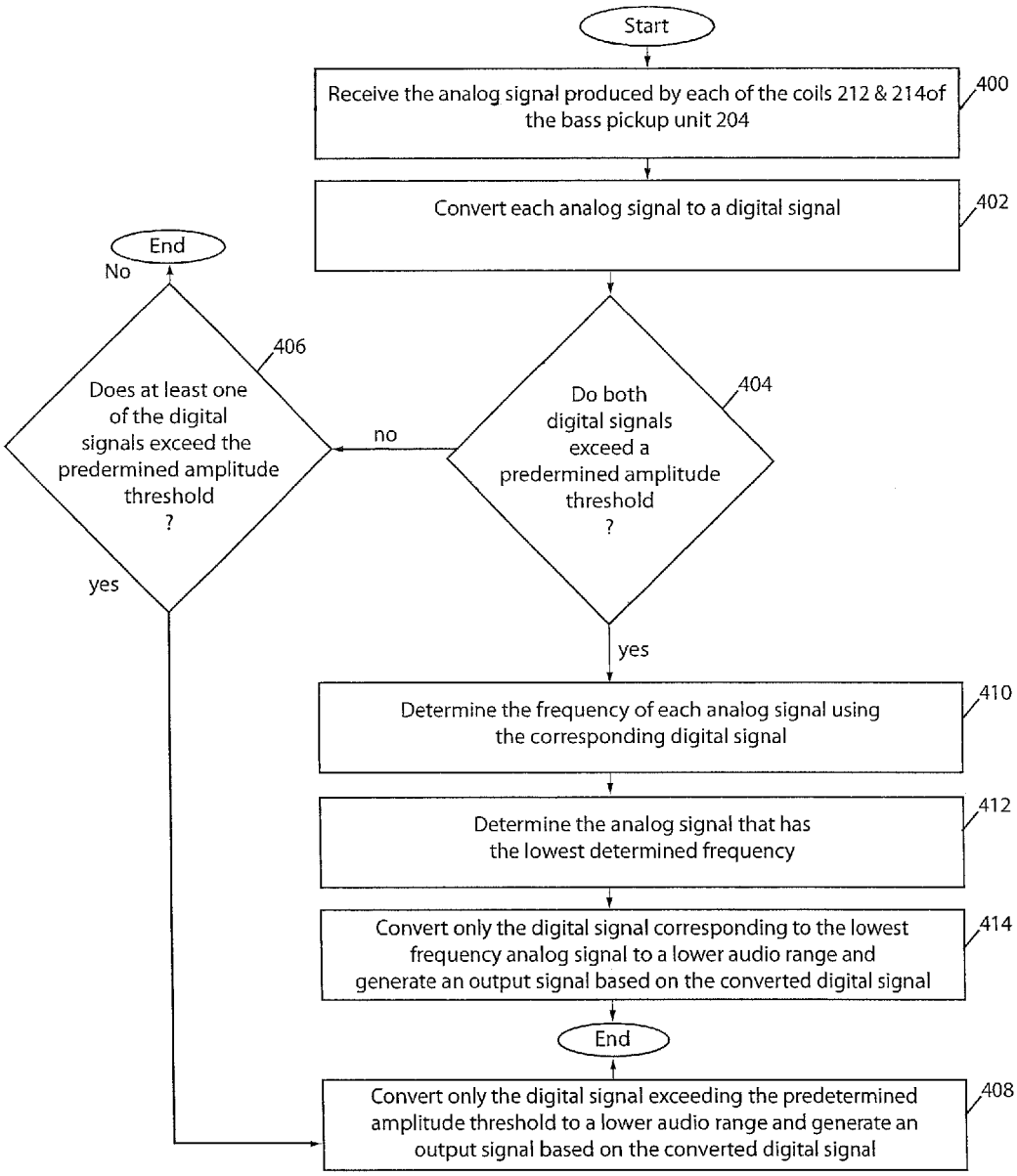
FIG. 12 is a flowchart showing an enhanced methodology of the present invention according to one exemplary embodiment as implemented in the guitar and the pick-up unit shown in FIGS. 9A, 9B and 10.

Referring to FIG. 12, the enhanced methodology of the present invention according to one exemplary embodiment as implemented in the guitar 200 and the pick-up unit 202 shown in FIGS. 9A, 9B and 10 will now be described in more detail. As noted elsewhere herein, this is not meant to be limiting, and it will be understood that that the enhanced methodology of the present invention may be implemented in connection with other configurations shown and described herein and/or other similarly configured electrical stringed instruments. The method begins at step 400, wherein the analog signal produced by each of the coils 212 and 214 of the bass pick-up unit 204 in response to vibration of the strings 208 and 210, respectively, is received in the unit including the DSP (e.g., DSP 64 shown in FIG. 4). Next, at step 402, each of the two received analog signals is converted into a corresponding digital signal by, for example, A/D converter 62 (FIG. 4). The digital signals are then provided to the DSP 64. At step 404, the DSP 64 makes a determination as to whether both of the digital signals exceed some predetermined amplitude threshold level. In this exemplary embodiment, this determination is performed in order to make sure that each analog signal was generated in response to an intended force being applied to the corresponding string 208, 210, as opposed to having been touched accidently when trying to play other ones of the strings. As will be appreciated, such an accidental touching will likely produce a much lower amplitude signal. As will be seen from the description below, in such a case, the analog signal will be ignored in the present exemplary embodiment. This is commonly known as an electronic noisegate, which attenuates signals below the programmed threshold, permitting only those over defined threshold through the signal path for further processing. In addition, when an electric guitar string, such as the lowest string, E, at 0.046" gauge, is tuned to pitch at 82.41 Hz, it has approximately 17.5 lbs of pressure from the bridge to the nut. Thus, in one non-limiting exemplary embodiment, the predetermined amplitude threshold level may be an amplitude that corresponds to about 0.2 to 0.3 lb/pull (and preferably 0.25 lb/pull) on the string from the pick or finger striking the string.

If the answer at step 404 is no, meaning that both of the digital signals do not exceed the predetermined amplitude threshold level, then the method proceeds to step 406. At step 406, the DSP 64 makes a determination as to whether at least one of the digital signals exceeds the predetermined amplitude threshold level. If the answer is no, then the method ends, as it has been determined that neither analog signal was "intentional." If, however, the answer at step 406 is yes, then that means that only one of the two analog signals was "intentional," and the method proceeds to step 408. At step 408, the digital signal exceeding the predetermined amplitude threshold level (and only that signal) is converted by the DSP 64 to a lower frequency/audio range one or two octaves below its current level. The converted (pitch shifted) digital signal is then used to generate an output signal that is provided to the bass amplifier. In the exemplary embodiment, this is done by converting the converted (pitch shifted) digital signal back to analog form using D/A converter 66.

If, however, the answer at step 404 is yes, meaning that both of the digital signals exceed the predetermined amplitude threshold level and are thus "intentional," then the method proceeds to step 410. At step 410, the DSP 64 determines the frequency of each of the analog signals based on the corresponding digital signals generated in step 402. Next, at step 412, the DSP 64 determines/identifies which one of the analog signals has the lowest frequency (based on the frequency determinations of step 410). Then, at step 414, the digital signal representing the lowest frequency analog signal (and only that signal) is converted by the DSP 64 to a lower frequency/audio range one or two octaves below its current level. The converted (pitch shifted) digital signal is then used to generate an output signal that is provided to the bass amplifier. In the exemplary embodiment, this is done by converting the converted (pitch shifted) digital signal back to analog form using D/A converter 66. As will be appreciated, this will result in only one analog signal being pitch sifted and output and will thereby provide a higher quality, non-muddy/non-muddled bass sound.

Thus, in short, in the exemplary embodiment, two separate conventional magnetic pickup coils are used to generate analog signals from the vibration of the corresponding metals strings. These analog signals are then converted to digital signals by a DSP. Then, the DSP detects which digital signal represents the lowest frequency note and only converts that digital signal/note to a lower frequency/audio range (e.g. one or two octave pitch conversion) for output. Thus, when a note is resounded, the system and methodology of the present application attempts to detect the lowest note being played (as effected by any fretting or fingering being done on the strings) by measuring input through separate signals on each string (input generated in the form of analog signals by coils 212, 214 under strings 208, 210) and only applies the DSP pitch shifting/converting effect to that note which is decidedly the lowest frequency.

As described in detail above, in the illustrated embodiment, the lowest note being played is identified by identifying in the DSP the analog signal having the lowest associated frequency by having the DSP determine the frequency of each of the digital representations of the analog signals. It will be appreciated that this is but one possibility, and that other ways of determine the lowest note being played are also possible.

Figure 13:
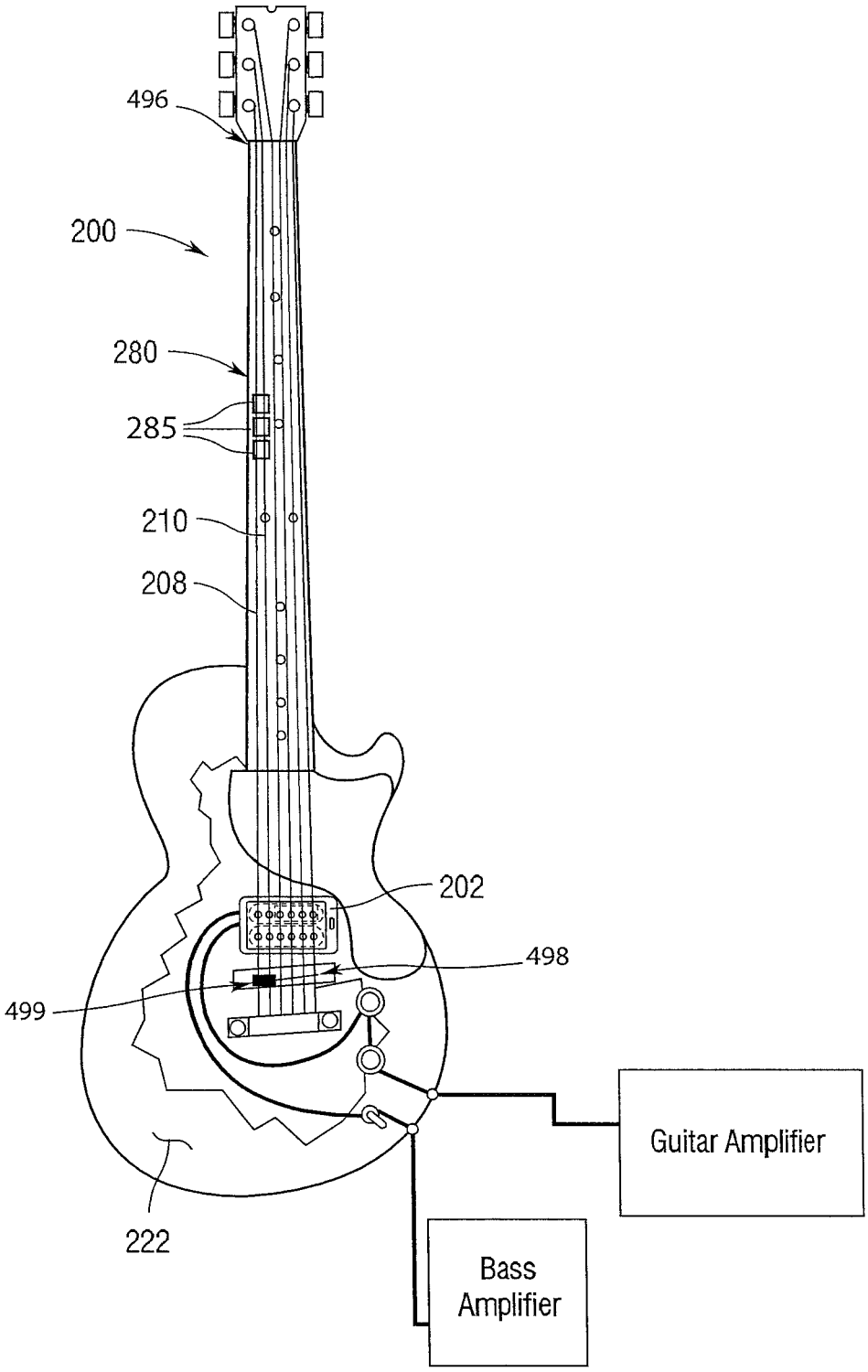
FIG. 13 shows a guitar in which the enhanced methodology of the present invention is implemented according to various embodiments.

For example, one alternative way to determine the lowest note being played is by using sensors on or under the fretboard of the instrument (see fretboard 280 and pressure sensors 285 in FIG. 13 which shows a modified guitar 200). More specifically, in the exemplary embodiment, one or more sensors 285 is/are placed on or under each fret of fretboard 280 in association with each string 208, 210. Each sensor is able to detect when finger pressure is being applied to the associated fret and string. The sensors 285 are coupled to the DSP 64, and as a result the DSP 64 is able to detect/determine which fret and which of the strings 208, 210 is receiving finger pressure. Based on that information, the DSP 64 may then determine which particular notes are being played on strings 208, 210 as the fretting hand applies pressure to sound notes and, as described elsewhere herein, give priority to the lowest note for the pitch conversion effect.

Another way to determine the lowest note being played is by sending a small electrical signal from one end of the string to the other. On an electric guitar, that would be a 10 millivolt (mV) signal current sent from a micro circuit located under the bridge saddles (see bridge saddles 498 and micro circuit 499 in FIG. 13) to the nut of the guitar (see nut 496 in FIG. 13) along each string 208, 210. When the finger interrupts the electrical signal being sent from the bridge saddles 498 to the nut 496, a calculation is made in the DSP 64 to determine where on the string 208, 210 the interruption occurred. Based on that information, the DSP 64 may then determine which particular notes are being played on strings 208, 210 as the fretting hand applies pressure to sound notes and, as described elsewhere herein, give priority to the lowest note for the pitch conversion effect.

In addition, in a conventionally tuned (standard A 440 Hz) guitar, the lowest open string is tuned to an "E" & vibrates at 82.41 Hz. Any notes at the $5^{th}$ fret and below on that string (110 Hz and below) can only be produced on that string and cannot be replicated on any other strings of the guitar. Thus, as a further enhancement of the method described herein (e.g., FIG. 12), in one alternative embodiment, if during processing to determine the lowest note for priority purposes the DSP detects/determines a frequency of 110 Hz or below (which would be food string 208 in the example), processing to determine the lowest note for priority purposes can stop, as that detected frequency/note will have to be the lowest. That signal can then be immediately given low note priority and the DSP pitch conversion effect can be applied thereto without further processing.

Figure 14:
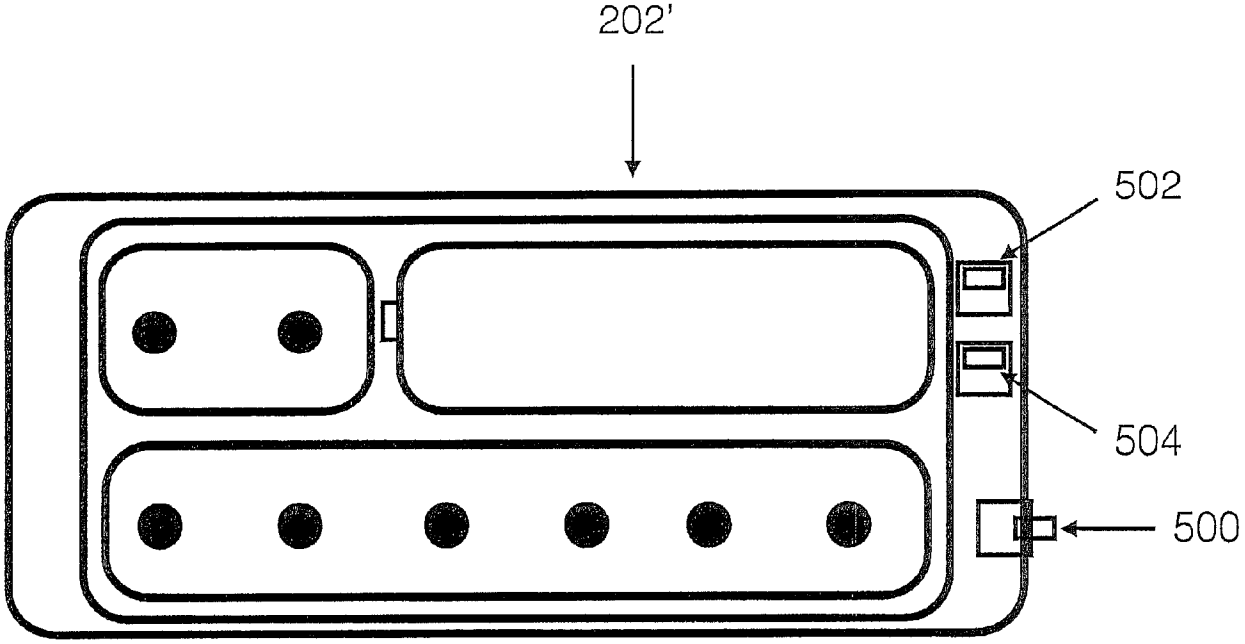
FIG. 14 is a schematic diagram of an alternative pick-up unit that may be used in the guitar of FIG. 13.

FIG. 14 is a schematic diagram of an alternative pick-up unit 202' that may be used in the guitar 200 of FIG. 13. Pick-up unit 202' includes a number of switches that may be used to control the operation of guitar 200. In particular, pick-up unit 202' includes a main on/off switch 500 for turning the functionality for extending the range of guitar 200 as described herein on and off, a selector switch 502 for determining to what degree the signals will be converted or transformed by the methodology described herein to extend the range of guitar 200 (e.g., one octave or two octaves), and a selector switch 504 for turning the low note priority functionality as described herein on and off.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A method of producing an output from an electrical stringed musical instrument having a plurality of strings and first and second pickup circuits, the first pickup circuit being associated with only a subset of the strings of the instrument and the second pickup circuit being associated with all of the strings of the instrument, the method comprising:

receiving a plurality of first analog signals, each first analog signal being generated by the first pickup circuit in response to vibration of a corresponding one of the subset of the strings and each first analog signal having an associated first frequency;

receiving a plurality of second analog signals, each second analog signal being generated by the first pickup circuit in response to vibration of a corresponding one of the subset of the strings and each second analog signal having an associated second frequency, wherein for each one of the subset of the strings the associated first frequency and the associated second frequency are the same;

identifying from among the first analog signals a particular one of the first analog signals having the lowest associated first frequency;

creating a first electrical signal based on only the particular one of the first analog signals, the first output electrical signal having a converted frequency that is lower than the associated first frequency of the particular one of the first analog signals; and creating a plurality of second output electrical signals, each second output electrical signal being based on a corresponding one of the second analog signals and having the associated second frequency of the corresponding one of the second analog signals.

2. The method according to claim 1, wherein the converted frequency is one or two octaves lower than the associated first frequency of the particular one of the first analog signals.

3. The method according to claim 1, further comprising generating a first output sound using the first output electrical signal.

4. The method according to claim 1, wherein the identifying comprises determining each of the associated first frequencies and determining which of the associated first frequencies is lowest.

5. The method according to claim 4, further comprising converting each of the first analog signals to an associated digital signal, wherein the determining each of the associated first frequencies is performed using each associated digital signal.

6. The method according to claim 5, wherein the determining each of the associated first frequencies is performed in a digital signal processor using each associated digital signal.

7. The method according to claim 1, further comprising simultaneously generating a first output sound using the first output electrical signal and a second output sound using the second output electrical signals.

8. An electrical stringed musical instrument comprising:

a plurality of strings; and a pickup unit having first and second pickup circuits, the first pickup circuit being associated with only a subset of the strings of the instrument and the second pickup circuit being associated with all of the strings of the instrument, the pickup unit being structured to:

(i) generate a plurality of first analog signals using the first pickup circuit, each first analog signal being generated in response to vibration of a corresponding one of the subset of the strings and each first analog signal having an associated first frequency;

(ii) generate a plurality of second analog signals using the second pickup circuit, each second analog signal being generated in response to vibration of a corresponding one of the subset of the strings and each second analog signal having an associated second frequency, wherein for each one of the subset of the strings the associated first frequency and the associated second frequency are the same;

(iii) identify from among the first analog signals a particular one of the first analog signals having the lowest associated first frequency;

(iv) create a first output electrical signal based on only the particular one of the first analog signals, the first output electrical signal having a converted frequency that is lower than the associated first frequency of the particular one of the first analog signals; and (v) create a plurality of second output electrical signals, each second output electrical signal being based on a corresponding one of the second analog signals and having the associated second frequency of the corresponding one of the second analog signals.

9. The electrical stringed musical instrument according to claim 8, wherein the first pickup circuit includes a plurality of first pickup coils structured to perform (i), wherein the second pickup circuit includes a plurality of second pickup coils structured to perform (ii), and wherein the pickup unit includes a signal processor structured to perform (iii), (iv) and (v).

10. The electrical stringed musical instrument en according to claim 8, wherein the converted frequency is one or two octaves lower than the associated first frequency of the particular one of the first analog signals.

11. The electrical stringed musical instrument according to claim 8, wherein said electrical stringed musical instrument is a guitar, and wherein the subset of the strings is a low E string and an A string of the guitar.

12. A pickup unit for an electrical stringed instrument having a plurality of strings, comprising:

a housing structured to be attached to an exterior of a body of said stringed instrument beneath said strings;

a first electromagnetic pickup supported by the housing, the first electromagnetic pickup being structured to be associated with only a subset of the strings when the housing is attached to the stringed instrument, the first electromagnetic pickup being structured to generate a plurality of first analog signals, each first analog signal being generated in response to vibration of a corresponding one of the subset of the strings and each first analog signal having an associated first frequency;

a second electromagnetic pickup supported by the housing, said second electromagnetic pickup being structured to be associated with all of the strings when the housing is attached to the stringed instrument, the second electromagnetic pickup being structure to generate a plurality of second analog signals, each second analog signal being generated in response to vibration of a corresponding one of the subset of the strings and each second analog signal having an associated second frequency, wherein for each one of the subset of the strings the associated first frequency and the associated second frequency are the same; and a signal processor structured to (i) identify from among the first analog signals a particular one of the first analog signals having the lowest associated first frequency, (ii) create a first output electrical signal based on only the particular one of the first analog signals, the first output electrical signal having a converted frequency that is lower than the associated first frequency of the particular one of the first analog signals, and (iii) create a plurality of second output electrical signals, each second output electrical signal being based on a corresponding one of the second analog signals and having the associated second frequency of the corresponding one of the second analog signals.

13. The pickup unit according to claim 12, wherein the converted frequency is one or two octaves lower than the associated first frequency of the particular one of the first analog signals.

* * * * *

UNITED STATES PATENT AND TRADEMARK OFFICE

CERTIFICATE OF CORRECTION

PATENT NO. : 9,064,483 B2
APPLICATION NO. : 14/170714
DATED : June 23, 2015
INVENTOR(S) : Andrew J. Alt It is certified that error appears in the above-identified patent and that said Letters Patent is hereby corrected as shown below:

In the specification
Column 4, line 36, “describe” should read --described--.
Column 10, line 8, “that that” should read --that--.
Column 11, line 16, “metals” should read --metal--.
Column 11, line 35, “of” should read --to--.
Column 12, line 2, “&” should read --and--.
Column 12, line 10, “food” should read --form--.
In the claims
Column 13, line 8, Claim 1, “first electrical” should read --first output electrical--.

Signed and Sealed this
Fifth Day of January, 2016

Michelle K. Lee

Michelle K. Lee
*Director of the United States Patent and Trademark Office*